United States Patent [19]

Bako

[11] 4,341,101

[45] Jul. 27, 1982

[54] COMBINATION LOCKS

[75] Inventor: Lazlo Bako, Woodcliff Lake, N.J.

[73] Assignee: Presto Lock, Inc., Garfield, N.J.

[21] Appl. No.: 167,429

[22] Filed: Jul. 11, 1980

[51] Int. Cl.[3] ..... E05B 37/02

[52] U.S. Cl. ..... 70/312; 70/318

[58] Field of Search ..... 70/20, 21, 22, 23, 24, 70/25, 26, 27, 28, 29, 30, 67, 68, 69, 70, 71, 72, 73, 74, 75, 76, 312, 315, 316, 317, 318

[56] References Cited

U.S. PATENT DOCUMENTS

| | | | |
|---|---|---|---|
| 2,163,852 | 6/1939 | Pond | 70/21 |
| 3,555,860 | 1/1971 | Atkinson | 70/312 |
| 3,720,082 | 3/1973 | Feinberg et al. | 70/25 |
| 3,766,758 | 10/1973 | Heine et al. | 70/25 |
| 3,800,571 | 4/1974 | Heine | 70/71 |
| 4,048,821 | 9/1977 | Bako et al. | 70/25 |
| 4,123,923 | 11/1978 | Bako | 70/74 |

*Primary Examiner*—Robert L. Wolfe

*Attorney, Agent, or Firm*—Shapiro and Shapiro

[57] ABSTRACT

A dial and sleeve type combination lock is provided with a shift member to move the sleeves out of coupling engagement with the dials for changing the combination of the lock. The shift member includes a manual actuator portion extending through an opening in the face plate of the lock. Axial movement of the sleeves out of coupling engagement with the respective dials is effected through a camming action by moving the manual actuator portion in the opening axially in the opposite direction to the direction of movement of the sleeves.

8 Claims, 9 Drawing Figures

COMBINATION LOCKS

BACKGROUND OF THE INVENTION

The use of combination locks, which dispense with the need for a separate key, has in recent years become increasingly popular on articles such as luggage articles, camera, and instrument cases, and the like.

Such locks commonly employ a mechanism whereby the combination of the lock can be changed to one of the user's own choice, by manipulation of a combination-changing mechanism. In the case of locks, for example, of the rotary dial and sleeve type, where for combination changing it is necessary to move the sleeves or other combination elements axially out of coupling engagement with the dials or the like, this is normally accomplished by a shift member having a manual actuator. Generally, the actuator has only been accessible from the back of the lock, i.e., from the interior of the article to which the lock is applied and, in certain instances, this has proved to be cumbersome in operation. Further, the actuator has generally needed to be moved in the axial direction of movement of the sleeves relative to the dials in order to uncouple the sleeves from the dials. (See, for example, U.S. Pat. No. 3,800,571 to Heine, issued Apr. 2, 1974, and commonly assigned herewith.)

It is an object of the present invention to provide a novel form of shift mechanism for a combination lock of the type in which a plurality of combination elements such as sleeves are moved axially in unison in order to effect a combination change.

Another object of the invention is to provide a combination lock of the type having a plurality of combination elements adapted to be moved axially in unison in order to effect a combination change, wherein an actuator for shifting the elements is moved in a direction other than the axial direction of movement of the elements.

A further object of the invention is to provide a combination lock suitable for use on articles of luggage and the like, wherein a shift mechanism for changing the combination of the lock is readily accessible from the exterior of the article to which the lock is applied.

It has previously been proposed in connection with combination padlocks, for example, which employ rotary dials and sleeves, to move the sleeves out of coupling engagement with the dials by utilizing the longer leg of the padlock shackle to provide axial movement of the sleeves by movement of the shackle in a direction other than the direction of axial movement of the sleeves (see, for example, U.S. Pat. No. 3,766,758 to Heine et al, issued Oct. 23, 1973, and U.S. Pat. No. 4,048,821 to Bako et al, issued Sept. 20, 1977). The present invention, however, is primarily concerned with providing an alternative and simplified means for effecting axial movement of the combination elements, for combination changing purposes, by means of an actuator which is operated other than in the direction of movement of the elements.

SUMMARY OF THE INVENTION

In accordance with the invention, at least in a preferred embodiment thereof, axial movement in one direction of the combination elements of a combination lock in order to effect a change in combination, is provided by moving an actuator axially in the opposite direction, such movement of the actuator being converted through camming means into axial movement of the combination elements in said one direction.

In a preferred form, the combination elements, such as combination sleeves in a sleeve and dial type lock, are carried end-to-end on a shaft in a lock casing and the actuator is formed as a portion of a shift member mounted for axial rocking movements on one end of the shaft. The actuator extends through an opening, preferably in the face plate of the lock, and, when the lock is on combination, the actuator can be moved axially in the opening in a direction opposite to the direction of movement of the combination elements. This movement of the actuator provides a rocking motion of the shift member which, reacting against an internal surface of the lock casing, presses the combination elements axially in the required direction of movement by camming surfaces formed on the shift member. The invention may be applied to locks having different forms of locking members and is particularly applicable to locks employing locking members of the pivotal bolt type.

DESCRIPTION OF THE PREFERRED EMBODIMENT

The illustrated combination lock is of a generally known type employing a locking member in the form of a pivotal bolt adapted to engage a hasp, the bolt being movable between locking and unlocked positions under the control of a plurality of combination dials and sleeves. The arrangement is such that when the dials and sleeves are on combination, the bolt automatically assumes its unlocked position in which the hasp can be inserted into or withdrawn from the lock and when the dials and sleeves are off combination, the bolt automatically assumes its locking position in which it prevents an inserted hasp from being withdrawn from the lock.

Locks having the above type of locking and unlocking action are known, see, for example, U.S. Pat. No. 3,800,571, referred to above. It is to be understood that the present invention is not concerned with the locking and unlocking action per se, and this form of lock is merely used for illustrative purposes as one type of lock to which the present invention can be applied. Thus, the present invention is concerned with a shift mechanism for moving combination elements such as sleeves axially out of coupling engagement with associated lock components in order to effect a combination change. The invention can be applied to locks having a locking and unlocking action different to the pivotal bolt type locking and unlocking action herein referred to.

Figure 1:
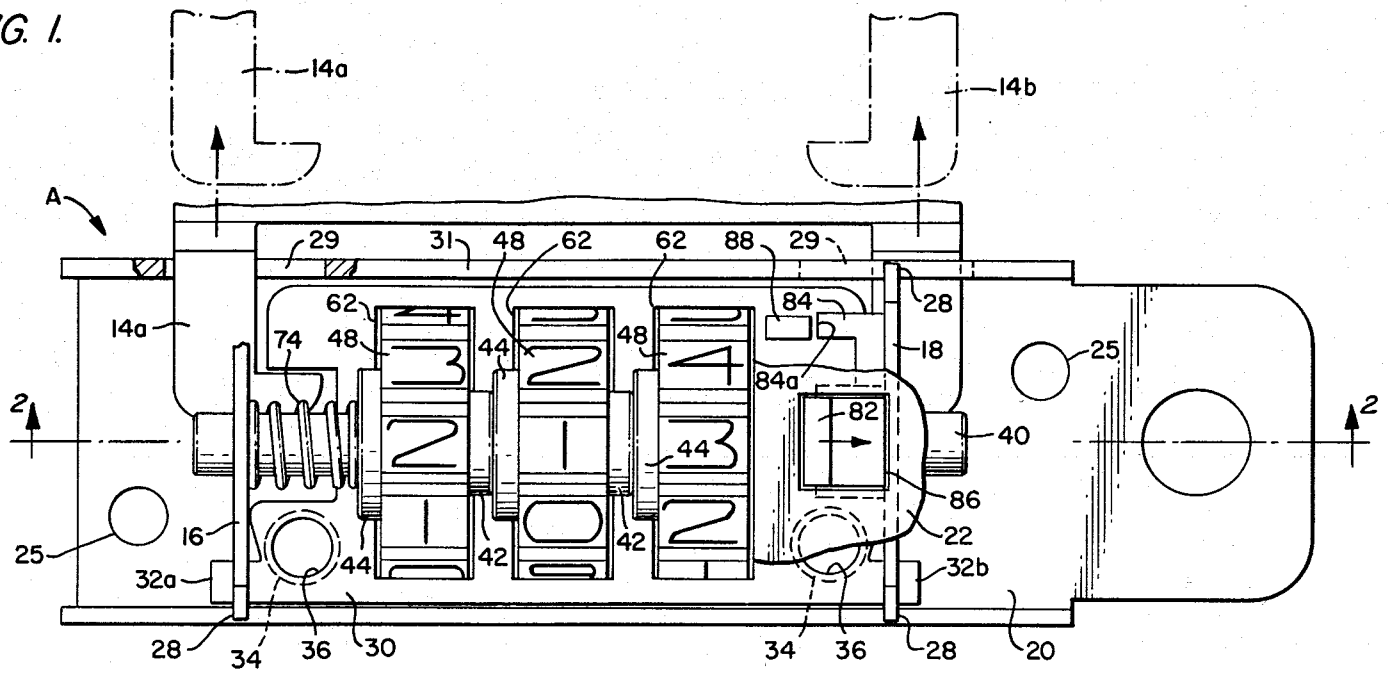
FIG. 1 is a plan view of a combination lock in accordance with the invention, with parts of the lock being cut away.

Referring now specifically to the drawings, the illustrated lock generally indicated by reference A, may be attached to a valance B of one section of say a luggage article (see FIG. 3), with the other section C of the article carrying a hasp 10 having projecting tongues 14*a*, 14*b* (FIG. 1) adapted to enter openings in the lock and engage a pivotal bolt 30 to releasably secure the sections of the luggage or a like article together.

Lock A has a casing which may, for example, be formed by a channel shaped base member 20, a face plate 22, side wall members 24 and 26, and end brackets 16 and 18. The design and assembly of the casing components is not critical and can follow established practice for locks of this type. As illustrated, base member 20 has openings 25 for attaching the lock, as by screws, rivets, or the like, to valance B and side wall member 24 has openings (not shown) which align with similar openings 29 in the upright wall 31 of base member 20 for admission of the hasp tongues 14*a* and 14*b*.

Figure 9:
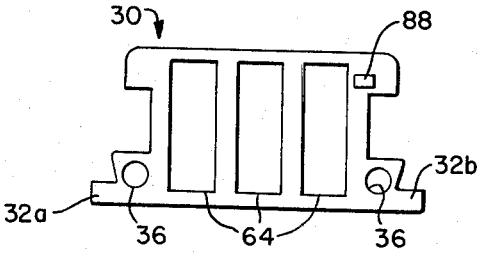
FIG. 9 is a plan view of a pivotal bolt.

Brackets 16 and 18 which define opposite end walls of the casing respectively, may for example, be located in recesses 28 in the opposed upright walls of base member 20. The pivotal bolt 30 (FIG. 9) is mounted in brackets 16 and 18 by ears 32*a* and 32*b* of the bolt which fit in corresponding openings in the brackets and coil compression springs 34 act between base member 20 and bosses 36 on the undersurface of the bolt, to urge the bolt upwardly into the position shown in FIG. 2 and shown in solid line in FIGS. 3 and 4. In this, the unlocked position of the bolt, the hasp tongues 14*a* and 14*b* are free to enter and be removed from the lock through openings 29. When bolt 30 is lowered, however, to the locking position, against springs 34, by means to be described, and as shown in phantom in FIGS. 3 and 4, bolt tongues 30*a*, 30*b* align vertically with the hasp tongues 14*a*, 14*b* to prevent disengagement of the hasp. Downward movement of bolt 30 is limited by a stop 39 on base member 20.

Figure 8:
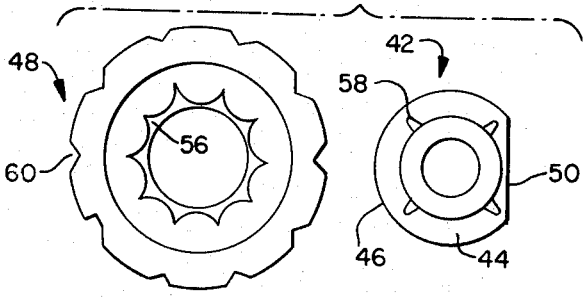
FIG. 8 is a composite end view of a combination dial and combination sleeve.

Brackets 16 and 18 also serve to mount a shaft 40 carrying a series of combination elements in the form of three abutting sleeves 42 arranged end-to-end on the shaft, each sleeve having an encircling combination dial 48. The dials and sleeves (see FIG. 8) are of conventional type, insofar as the dials have internal teeth 56 or the like, which mesh with complementary teeth 58 or the like on the sleeves whereby the respective dials and sleeves are coupled for mutual rotation on the shaft 40. The dials also have a conventional series of circumferential combination indicia on their outer surfaces with locating detents 60 therebetween (see FIG. 8) and a portion of the periphery of each dial protrudes from the casing through respective slots 62 in face plate 22. Similarly, the dials protrude through aligned slots 64 in bolt 30. A conventional dial spring 68 on base member 20 has limbs 70 engaging in the detents 60 of the respective dials.

Figure 2:
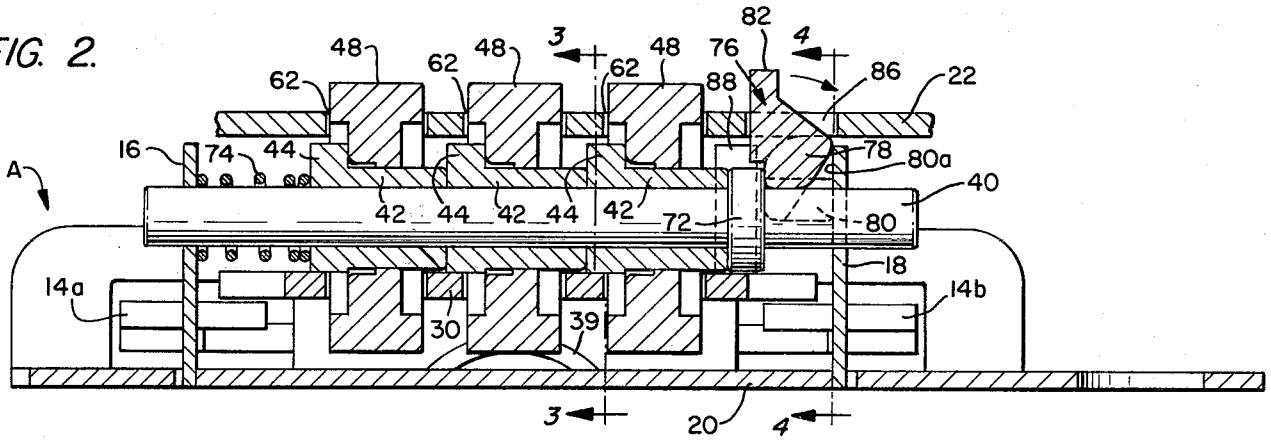
FIG. 2 is a longitudinal section along line 2—2 of FIG. 1.

Shaft 40 further has a fixed or integrally formed collar 72 adjacent the right-hand sleeve 42 (as seen in FIG. 2), a coil spring 74 surrounding the shaft and acting between bracket 16 and the left-hand sleeve 42, and a shift member 76 mounted for rocking movement on the shaft between collar 72 and bracket 18 as will be described. Spring 74 urges the assembly of sleeves, shaft and shift member to the right as seen in FIG. 2, and holds the sleeves in coupling engagement with the respective dials.

Figure 3:
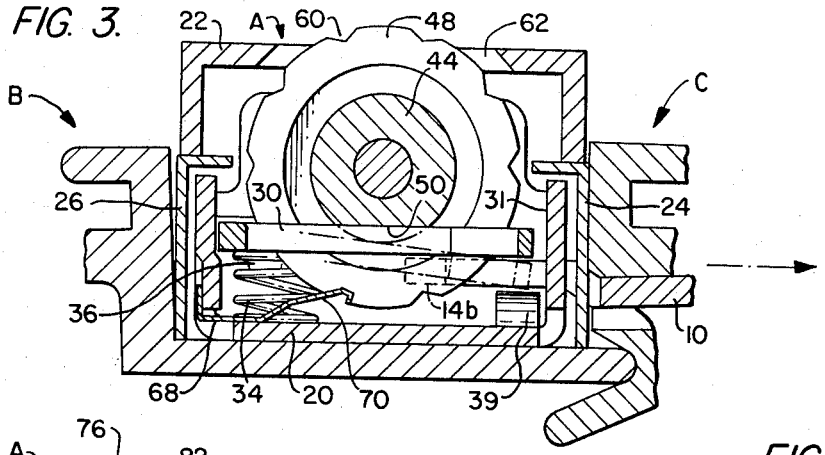
FIG. 3 is a cross section along line 3—3 of FIG. 2.
Figure 4:
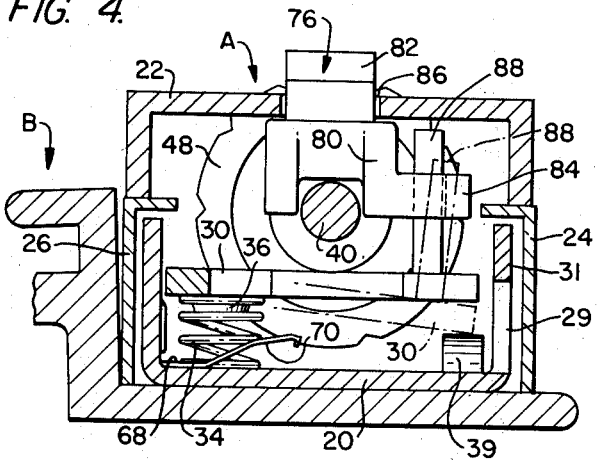
FIG. 4 is a cross section along line 4—4 of FIG. 2.

Sleeves 42 have enlarged bosses 44 at the left-hand ends thereof defining circumferential cam surfaces. These cam surfaces each have part-circular portions 46 and flattened portions 50 (see FIG. 8), and the cam surfaces act on the upper surface of bolt 30 to control the position of the bolt. Thus, when all the sleeves are aligned by suitable manipulation of the dials, such that the flattened portions of the respective sleeves all engage the bolt (i.e., the on-combination condition), as shown in FIGS. 2 and 3, the bolt is free to rise to the unlocked position. If at least one of the sleeves is rotated from this position, the part-circular portion of the sleeve's cam surface cams the bolt down to the locked position. Thus, for the bolt to be unlocked, all the sleeves must have their flat portions in aligned engagement with the bolt, and for the bolt to be locked, any one, or more of the sleeves must be rotated so that the part-circular cam portion engages the bolt. This form of locking and unlocking action, as indicated, is known and will be readily apparent to those skilled in the art.

To enable the combination of the lock to be changed, it is necessary to move the sleeves 42 axially out of coupling engagement with the respective dials 48, so that at least one of the dials can be rotated independently of its respective sleeve. This is accomplished by shift member 76 when the lock is on combination as will now be described.

Figure 7:
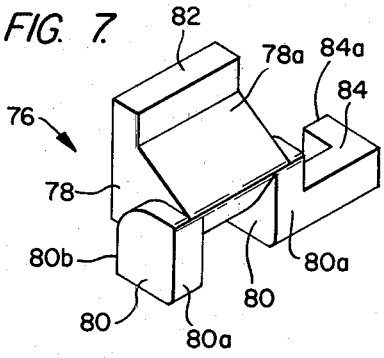
FIG. 7 is a perspective view of a shift member used in the lock.

Shift member 76, as shown particularly in FIG. 7, includes a body portion 78, laterally spaced limbs 80 which depend from the body portion and straddle shaft 40, an upwardly projecting manual actuator portion 82, and a substantially L-shaped lateral extension 84 formed on one of the limbs 80. Manual actuator portion 82 projects from the lock casing through an opening 86 in face plate 22. Extension 84 coacts with an upstanding limb 88, connected to or integrally formed on bolt 30.

In the normal rest position of shift member 76, as shown for example in FIG. 2, the rear surfaces 80*a* of limbs 80 engage bracket 18 while the forward surfaces 80*b* of the limbs engage the shaft collar 72. Manual actuator portion 82 extends upwardly through the left-hand end of opening 86. When the lock is off combination, the bolt being in its locked, lowered position, shown in phantom in FIG. 4, limb 88 on bolt 30 is in blocking position with respect to terminal edge surface 84*a* of the shift member extension 84. This relative positioning of limb 88 and extension 84 is clearly shown in full line in FIG. 1. Because of the blocking relationship between these elements, manual actuator portion 82 of the shift member cannot effectively be moved to the right in opening 86. When the lock is on combination, however, with the bolt in its raised, unlocked position, limb 88 is moved effectively to the position shown in FIG. 6, clearing the edge 84*a* of extension 84 and allowing the shift member to be rocked on shaft 40 by movement of actuator portion 82 to the right as shown in FIG. 2. This rocking movement of the shift member exerts a camming action on shaft collar 72 through the forward surfaces 80*b* of limbs 80, and with the shift member reacting against bracket 18. This camming action moves shaft 40 and sleeves 42 to the left, to uncouple the respective sleeves and dials. The shift member may be brought into the position shown in FIG. 5 where the rear surface 78*a* of body portion 78 abuts bracket 18. In this condition, the manual actuator portion 82 can be released, and the shift member will hold the shaft and sleeves in the combination changing position. It will be seen that axial movement of the sleeves in one direction, in order to effect a combination change, is thus responsive to axial movement of the actuator portion 82 in the opposite direction, the movement of the sleeves being effected by cam surfaces on the shift member, with the shift member reacting against the internal surface of bracket 18.

Figure 5:
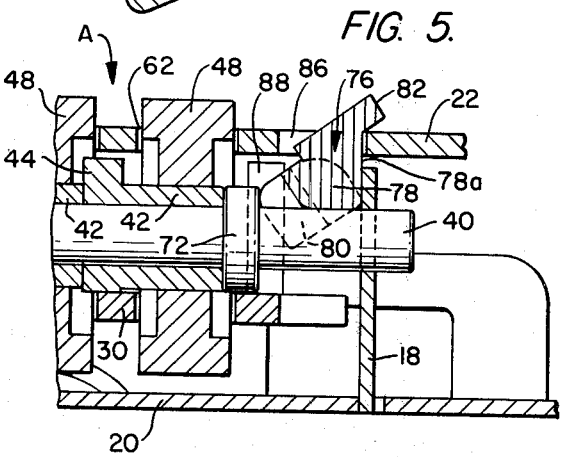
FIG. 5 is a view similar to FIG. 2 but showing parts of the lock in a combination changing condition.
Figure 6:
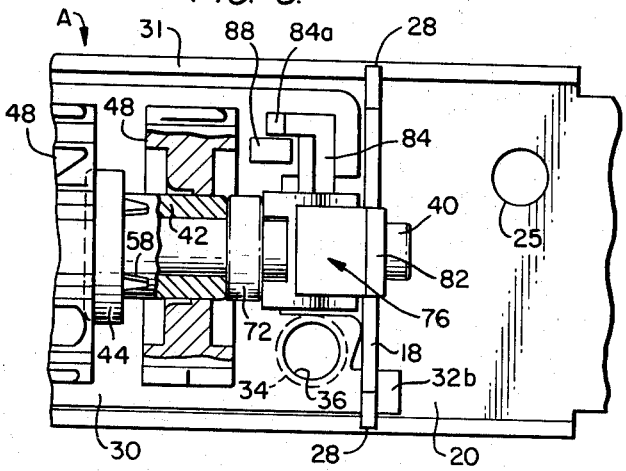
FIG. 6 is a plan view of part of the lock with the face plate removed and with the lock components being shown in the combination changing condition.

In the combination changing position shown in FIGS. 5 and 6, bolt 30 cannot be lowered to the locked position since limb 88 is trapped behind extension 84 of the shift member. The bolt is thus held in its raised position thereby preventing sleeves 42 from rotating and losing the combination. After the combination has been changed, actuator portion 82 is returned to the rest position shown, for example, in FIG. 2, allowing spring 74 to return the sleeves axially into coupling engagement with the respective dials, thereby setting the new combination.

It will be seen from the foregoing that the invention provides a convenient form of shift mechanism for use with combination locks, suitable for application to articles of luggage or the like, which mechanism can be operated from the top of the lock, i.e., from externally of the article to which the lock is applied. Further, the shift mechanism is operated by moving a manual actuator other than in the direction of movement of the combination elements that are moved.

While only a single preferred embodiment of the invention has been described herein in detail, it is to be understood that the invention is not limited thereby, and modifications can be made within the scope of the attached claims.

I claim:

1. A combination lock including a plurality of combination elements disposed on a common axis in a casing for axial movement in unison in one direction to uncouple said elements from cooperating combination components in order to change the combination of the lock, a shift member for moving said elements axially, said shift member including an actuator portion extending through an opening in said casing and means providing a camming action between said shift member and said elements for causing said shift member to move said elements axially in said one direction responsive to axial movement of said actuator portion in said opening in the opposite direction.

2. A lock as defined in claim 1, wherein said shift member is mounted in said casing for engagement against an internal surface of said casing and wherein said means providing a camming action includes camming surface means on said shift member effective to move said combination elements axially in said one direction by reaction of said shift member against said surface when said actuator portion is moved axially in said opening in the opposite direction.

3. A lock as defined in claim 2, wherein said combination elements comprise sleeves mounted axially in abutting relation on a shaft defining said axis and said cooperating combination components comprise dials encircling said sleeves, said dials having peripheral portions extending through slots in a face plate of the lock, said opening being formed in said face plate.

4. A lock as defined in claim 3, wherein said shift member is mounted for rocking movement on said shaft between a terminal one of said sleeves and said surface, said shift member including laterally spaced limbs straddling said shaft and defining said camming surface means.

5. A lock as defined in claim 4, including a collar on said shaft between said terminal one of said sleeves and said shift member, said shift member engaging said collar to move said shaft and said sleeves axially responsive to movement of said actuator portion in said opening.

6. A lock as defined in claim 1, including a locking member in said casing controlled by said combination elements for movement between locking and unlocked positions, said shift member including an extension cooperating with said locking member when said locking member is in locking position for preventing movement of said actuator portion in said opening, said extension clearing said locking member when said locking member is moved to unlocked position.

7. A lock as defined in claim 6, wherein said actuator portion has a terminal position in said opening for holding said combination elements in combination changing position, said extension cooperating with said locking member in said terminal position of the actuator portion to retain said locking member in unlocked position.

8. A lock as defined in claim 6, wherein said locking member is a pivotal bolt and said sleeves each include a flange having a cam surface engaging said bolt for controlling movement of said bolt between said locking and unlocked positions dependent upon the alignment of the respective cam surfaces.

* * * * *